United States Patent [19]

Mizuno

[11] Patent Number: 4,920,340

[45] Date of Patent: Apr. 24, 1990

[54] VEHICLE DETECTING METHOD AND SYSTEM WHICH CAN COMMUNICATE WITH VEHICLES

[75] Inventor: Masao Mizuno, Kyoto, Japan

[73] Assignee: Omron Tateisi Electronics Co., Kyoto, Japan

[21] Appl. No.: 854,312

[22] Filed: Apr. 21, 1986

[30] Foreign Application Priority Data

Apr. 22, 1985 [JP] Japan ..... 60-86064

[51] Int. Cl.[5] ..... G08G 1/09

[52] U.S. Cl. ..... 340/905; 340/933; 340/939; 340/941

[58] Field of Search ..... 340/933, 904, 905, 941, 340/988, 989, 991, 992, 52 R, 551, 939; 191/10; 266/122 R, 247, 249

[56] References Cited

U.S. PATENT DOCUMENTS

| | | | |
|---|---|---|---|
| 2,201,145 | 5/1940 | Barker | 340/551 |
| 2,532,231 | 11/1950 | Jarvis | 340/551 |
| 3,742,150 | 6/1973 | Sherman et al. | 340/905 |
| 3,911,389 | 10/1975 | Mills | 340/941 |
| 3,996,555 | 12/1976 | Dow | 340/941 |
| 4,075,553 | 2/1978 | Bouverot et al. | 340/941 |
| 4,232,285 | 11/1980 | Narbaits-Jaureguy et al. | 340/941 |
| 4,276,539 | 6/1981 | Eshraghian et al. | 340/941 |
| 4,529,982 | 7/1985 | Karlstrom et al. | 340/941 |
| 4,532,511 | 7/1985 | Lemelson | 340/933 |
| 4,630,044 | 12/1986 | Polzer | 340/941 |
| 4,661,799 | 4/1987 | Buttemer | 340/933 |

*Primary Examiner*—Joseph A. Orsino
*Assistant Examiner*—Brent A. Swarthout
*Attorney, Agent, or Firm*—Stevens, Davis, Miller & Mosher

[57] ABSTRACT

A vehicle detecting system detects the existence of a vehicle on a roadway and communicates therewith in the following manner. A pair of transmitting and receiving coils are arranged on both sides of a detection area set over the roadway of the vehicle. The first high frequency signal of the first frequency is applied to the transmitting coil to form the high frequency magnetic field between those coils. The existence of the vehicle is detected on the basis of the point such that the characteristic such as level or phase of the signal induced in the receiving coil changes due to the vehicle which entered the magnetic field. The first high frequency signal which is applied to the transmitting coil is modulated by the data to be transmitted to the vehicle. Or, the second high frequency signal which has the second frequency different form the first frequency of the first signal and is transmitted from the vehicle is received by the receiving coil and demodulated.

20 Claims, 6 Drawing Sheets

VEHICLE DETECTING METHOD AND SYSTEM WHICH CAN COMMUNICATE WITH VEHICLES

BACKGROUND OF THE INVENTION

1. Field of the Invention

The present invention relates to method and system for detecting the existence of vehicles, passage of vehicles, and the like, and for communicating between the vehicle side and the ground side. Such method and system are applied to the following systems: namely, the traffic control system which counts the number of vehicles passed on the basis of the detection of the vehicles, thereby smoothing the flow of vehicles; the system which detects the vehicles which run a toll road and automatically collects the tolls; the system which detects the vehicles entering a parking lot and automatically collects the parking fees; the system which informs the jam situation and the like of an express highway or other roads to each vehicle; the system which detects the running positions of the special vehicles such as bus, patrol car, taxi, unmanned conveying truck which runs in a warehouse, and the like and at the same time communicates between these vehicles and the control center; and the like.

2. Description of Prior Art and Prior Japanese Background Application

As typical one of conventional vehicle detecting systems, there has been known a system including an almost square loop coil buried under the road surface. A high frequency exciting current flows through the loop coil. When the vehicle passes above the loop coil, the inductance of the coil changes, so that the value of the current also varies. The passage of the vehicle can be recognized by detecting the change in this current.

As background to this invention has already proposed the system using such a loop coil in which the communication is performed between the vehicles passing above the loop coil and the control center on the ground side (Japanese Patent Application No. 60-41678). According to this '678 system, in the case of transmitting data to the vehicle side from a control unit installed at a predetermined location (hereinafter, this control unit or the like is referred to as a ground side), a high frequency current which is allowed to flow through the loop coil is modulated by the data to be transmitted, and the modulated signal is received by a receiver equipped in the vehicle. In the case of transmitting data from the vehicle side to the ground side, a signal having a frequency different from that of the foregoing high frequency current is transmitted from a transmitter provided for the vehicle. At this time, the loop coil functions as a kind of antenna and receives the signal from the vehicle. Therefore, by demodulating this signal, the vehicle data can be obtained on the ground side.

However, such a communicating system has the following problems.

One loop coil is commonly used to transmit the high frequency signal from the ground side to the vehicle side, and to receive the signal transmitted from the vehicle side and take out the vehicle detection signal. Therefore, switching means is needed and the switching operation of the switching means must be controlled, causing the constitution to become complicated.

After completion of the detection of the vehicle, data is transmitted to the vehicle and then the data from the vehicle is received. In this manner, together with the changeover of the switching means, these operations must be time-sharingly executed. Consequently, in the case where a plurality of vehicles pass the roadway at a fairly short distance between vehicles, there is the fear of occurrence of the malfunction of the system.

Further, the vehicle detecting system using the loop coil has the following problems.

In general, the loop coil has the size of about 2 m×2 m and the road must be dug up over a wide range to bury such a large loop coil into the road. Such a burying construction is a large-scaled, so that the construction expenses increase and much labors are needed for the construction.

The loop coil buried under the road surface is frequently subjected to the loads in association with the passages of vehicles, so that the accident of disconnection of the coil is likely to occur. The occurrence of the accident of the disconnection disenables the detection of vehicles.

SUMMARY OF THE INVENTION

It is an object of the present invention to solve the foregoing drawbacks in the conventional vehicle detecting system of the type using the loop coil and enable the communication to be executed without any error.

According to a method of the present invention, a transmitting coil is arranged on one side of a predetermined detection area set over the roadway of vehicle and a receiving coil is arranged on the other side of the detection area, respectively. A high frequency signal is applied to the transmitting coil to develop a high frequency magnetic field between the transmitting and receiving coils. The existence of the vehicle is detected on the basis of the point such that the characteristic of the signal induced in the receiving coil changes due to the vehicle entered the magnetic field. The change in characteristic of the signal includes the change in signal level, change in signal phase, and the like.

With use of the transmitting and receiving coil, the data communication between the vehicle side and ground side is achieved. If the high frequency signal which is applied to the transmitting coil is modulated by the data to be transmitted to the vehicle, the data can be transmitted to the vehicle. Or, if the high frequency signal having a frequency different from that of the foregoing high frequency signal and transmitted from the vehicle is received by the receiving coil and demodulated, the data sent from the vehicle can be recognized.

The term "roadway" mentioned above denotes all of the locations where vehicles run and has the concept which apparently includes not only the ordinary road but also the road, floor, and the like in the factories or precincts. The terms "vehicle" and "vehicles" also have the wide meaning including not only what are called four-wheeled automobiles but also tricycle type automobiles, two-wheeled type vehicles, bicycles, unmanned conveying trucks, travelling robots, and the like. The transmitting and receiving coils may be buried under the roadway surface or may be set at positions of predetermined heights above the roadway. The detection area is the virtual area and is actually determined by the positions where the transmitting and receiving coils are arranged. One side and the other side of the detection area do not necessarily coincide with one side and the other side of the roadway. The transmitting and receiving coils may be provided at two positions along the running direction of the vehicle or may be provided at two positions which are away from each other at a predetermined distance in the direction perpendicular to the running direction of the vehicle. Further, those coils may be obliquely arranged with respect to those directions.

When the high frequency signal is supplied to the transmitting coil, the high frequency magnetic field is developed between the transmitting and receiving coils. When the vehicle passes in the magnetic field, the mutual inductance of both coils changes and the level of the electrical signal which is induced in the receiving coil changes. When the change in level of this received signal exceeds a predetermined value, the vehicle detection signal is outputted.

The sizes of transmitting and receiving coils are extremely smaller than the conventional loop coil. Therefore, even when these coils are buried in the roadway as well, the burying construction can be simplified as compared with the conventional one. In addition, it is not always necessary to bury the transmitting and receiving coils to detect the vehicle but these coils may be also installed on the roadway. In this case, the installing construction can be further simplified.

A transmitting circuit to supply the high frequency signal to the transmitting coil and a vehicle detecting circuit which outputs the vehicle detection signal on the basis of the change in the received signal level of the receiving coil may be enclosed in a box and this box may be arranged on one side of the roadway. In this case, it is sufficient to bury one of the transmitting and receiving coils, e.g., the transmitting coil on this side and to bury the other coil, e.g., the receiving coil on the other side of the roadway or in the central portion thereof, or the like. In this case, although the signal line connecting the receiving coil and vehicle detecting circuit must be buried so as to cross the roadway, it is sufficient to dig up the roadway along only a single line. In the case where the transmitting circuit and transmitting coil are arranged on one side of the roadway and the receiving coil and vehicle detecting circuit are arranged on the other side, respectively, there is no need to arrange the signal line so as to cross the roadway.

Further, in the case of providing the transmitting and receiving coils above the roadway, it is unnecessary to dig up the roadway.

Consequently, the possibility of the occurence of the accident of the disconnection decreases as compared with the conventional system in which the whole large loop coil is buried in the roadway.

Moreover, the space between the transmitting and receiving coils becomes the vehicle detection area and this detection area can be set to a wide region. Therefore, the deterioration of the sensitivity as compared with that of the conventional loop coil is not caused.

Furthermore, according to the present invention, the dedicated transmitting coil for only transmission and the dedicated receiving coil for only reception are independently provided, so that the data transmission, and data reception and vehicle detection can be independently executed. Therefore, the switching means as in the conventional system is unnecessary. Thus, the overall constitution can be relatively simplified. Because of the same reasons as above, the vehicle detection and the data transmission and reception can be simultaneously executed. Therefore, as compared with the conventional example in which those operations must be time-sharingly performed, a longer period of time can be secured for those operations. Consequently, even if a plurality of vehicles pass the roadway at a very short distance between vehicles as well, the accurate data communication can be executed.

DESCRIPTION OF THE PREFERRED EMBODIMENTS

Figure 1:
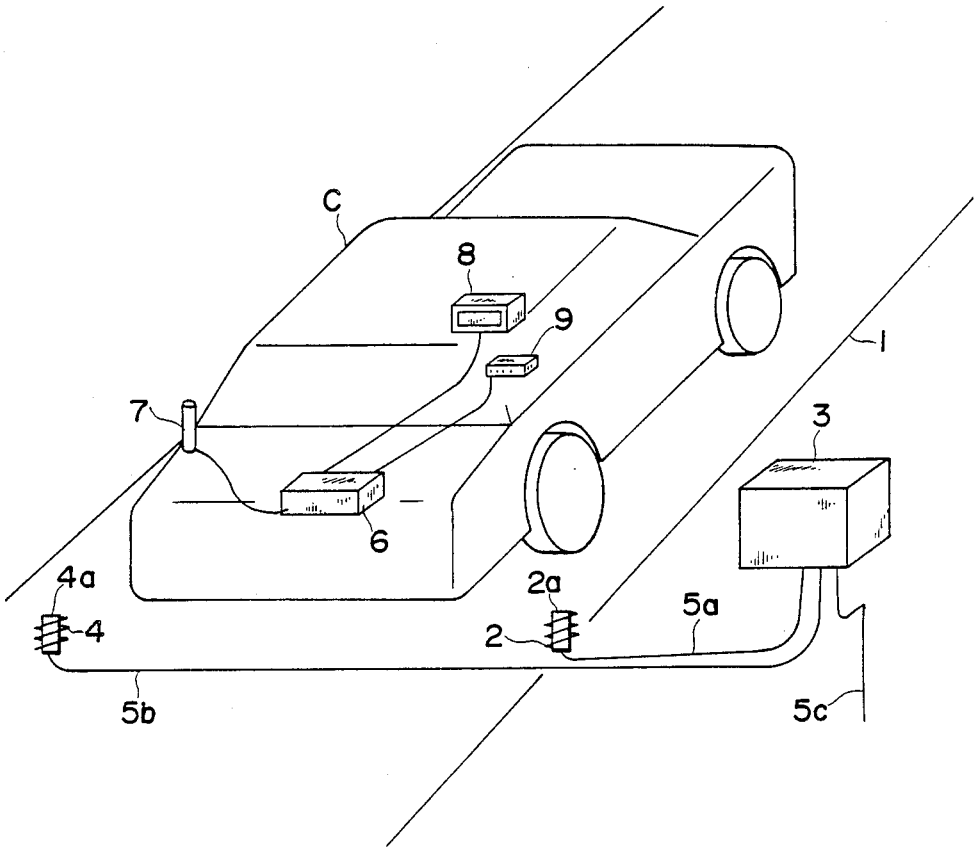
FIG. 1 is a diagram illustrating an arrangement of a transmitting coil and a receiving coil and an outline of apparatuses installed in a vehicle.

FIG. 1 shows an example of an arrangement of a transmitting coil 2 and a receiving coil 4 and equipment of a vehicle. The coils 2 and 4 are wound around magnetic cores 2*a* and 4*a*, respectively, and buried on both sides in the lateral direction of a roadway (e.g., one lane of the road) 1. The sizes of cores 2*a* and 4*a* are relatively small; for example, the length is about 70 mm and the diameter is about 15 mm. The cores 2*a* and 4*a* are arranged so that their longitudinal directions are the vertical direction. The distance between the transmitting coil 2 and the receiving coil 4 may be set to an arbitrary value and it will be ordinarily about one to a several meters. The area between the coils 2 and 4 substantially serves as the vehicle detection area. Therefore, the vehicle detection area may be set to an arbitray range and at an arbitrary location in accordance with the position where the coils 2 and 4 are arranged.

Either one of or both of the transmitting coil 2 and receiving coil 4 may be arranged on the roadway surface or may be also installed above the roadway surface (for example, at the position of height of about five meters) by a pole brace or the like which is vertically set on the roadway. Both coil 2 and 4 may be provided on one side of the roadway 1.

The transmitting and receiving coils 2 and 4 are connected to a control box 3 by lines 5*a* and 5*b* buried under the roadway surface and under the side portion thereof. The control box 3 is arranged on the side of the roadway 1 and connected to a central control unit (not shown) by a telephone line or other transmitting line 5*c*.

A vehicle C is equipped with a transceiver 6. An antenna 7 connected to the transceiver 6 is attached at a proper location of the vehicle C. A data display device 8 and a data setting device 9 which are installed in the vehicle C are also connected to the transceiver 6. The data is set in the data setting device 9 from the outside. The data set is transmitted to the control box 3 on the ground side as will be described later.

The transmitting coil 2 has the function to form a high frequency magnetic field for detection of the vehicle between the transmitting coil 2 and the receiving coil 4 and the function to transmit the data on the ground side to the antenna 7 of the vehicle C. The receiving coil 4, on one hand, has the function to form a magnetic field between the receiving coil 4 and the transmitting coil 2 and the function to receive the data signal on the vehicle side transmitted from the antenna 7.

Figure 2:
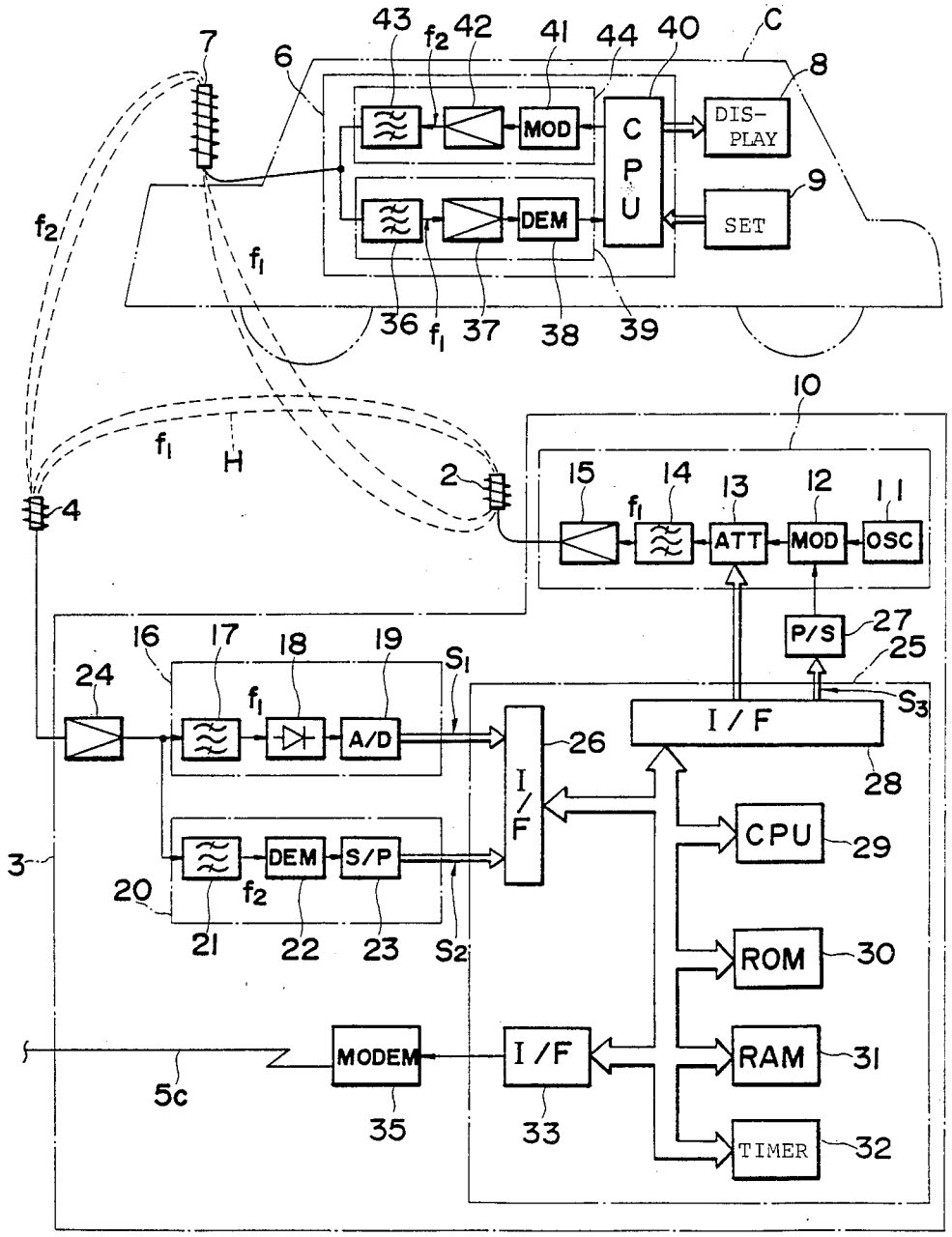
FIG. 2 is a block diagram showing an electrical arrangement of an embodiment of the invention.

FIG. 2 shows an example of a practical electrical arrangement of the control box 3 and transceiver 6 mentioned above.

The control box 3 includes a transmitting circuit 10, a vehicle detecting circuit 16, a receiving circuit 20, and a microprocessor 25 to control these circuits.

In the transmitting circuit 10, a high frequency signal is generated from an oscillating circuit 11. A frequency of the high frequency signal assumes $f_1$. When there is data $S_3$ to be transmitted to the vehicle C, this high frequency signal is modulated in a modulator 12 by the data $S_3$ to be transmitted. A minimum frequency shift keying (MSK) system is used as a modulating system. The transmitting data $S_3$ is given from the microprocessor 25 and this parallel data is converted to the serial data signal by a parallel-to-serial (P/S) converter 27 and then inputted to the modulator 12. If data to be transmitted to the vehicle C doesn't exist, the modulation is not executed. After an output signal of the modulator 12 was attenuated by an attenuator 13, its higher harmonic frequency component is removed by a band pass filter 14, so that only the component having the frequency $f_1$ as the center frequency is supplied to a power amplifier 15. An amount of attenuation of the attenuator 13 is controlled by the microprocessor 25 as will be explained hereinafter in a manner such that a level of a received signal which is induced in the receiving coil 4 when no vehicle exists becomes always predetermined value. An output signal of the amplifier 15 is supplied to the transmitting coil 2.

When the transmitting coil 2 is energized by an output of the amplifier 15, the high frequency electromagnetic field (mainly, the magnetic field H) is developed between the transmitting coil 2 and the receiving coil 4. A current or voltage signal is induced in the receiving coil 4 due to the magnetic field H. On one hand, as shown later, when a signal which is outputted from a transmitting circuit 44 of the transceiver 6 equipped in the vehicle C is supplied to the antenna 7, the signal is likewise received by the receiving coil 4. The antenna 7 also consists of a coil wound around a core. A center frequency of the high frequency signal which is outputted from the transmitting circuit 44 of the vehicle C assumes $f_2$.

The values of the frequencies $f_1$ and $f_2$ are different and set to values of about tens to hundreds of kHz. For example, $f_1$ is set to about 200 kHz and $f_2$ is set to about 300 kHz.

Namely, the signal having the center frequency $f_1$ and the signal having the center frequency $f_2$ are induced in the receiving coil 4. After these signals were amplified by an amplifier 24, they are inputted to the vehicle detecting circuit 16 and receiving circuit 20.

In the detecting circuit 16, the input signal passes through a band pass filter 17 having the center frequency $f_1$ and its noise component and the component of the frequency $f_2$ are removed, so that only the component having the center frequency $f_1$ is extracted. After this signal was detected by a detecting circuit 18, its level is converted into a digital value by an analog-to-digital (A/D) converter 19 and supplied to the microprocessor 25. The data indicative of the level of the received signal component of the frequency $f_1$ converted into the digital value is referred to as "(reception) data $S_1$ of $f_1$" hereinafter.

When the vehicle C enters the magnetic field H formed between the transmitting coil 2 and receiving coil 4, the mutual inductance of the coils 2 and 4 changes. The level of the received signal of the receiving coil 4 varies due to the change in mutual inductance. There are two cases: where the magnetic resistance between the coils 2 and 4 decreases in dependence on the material of the vehicle body or the height of vehicle, so that the received signal level increases (in the case where the vehicle body is made of iron); and where the received signal level decreases due to the eddy-current loss (in the case where the vehicle body is made of aluminum). In any of these cases, this change in received signal level appears in the reception data $S_1$ of $f_1$. As will be explained hereinafter, in the microprocessor 25, when the change amount of reception data $S_1$ of $f_1$ exceeds a threshold value $V_{th}$, it is decided that the vehicle is detected.

Only the component having the center frequency $f_2$ is extracted by a band pass filter 21 from the received signal of the receiving coil 4 inputted to the receiving circuit 20. Then the output signal of the filter 21 is demodulated by a demodulator 22. Since the signal component having the center frequency $f_2$ is transmitted from the vehicle C, the demodulated data is the data which was transmitted from the vehicle C to the control box 3 on the ground side. This serial data is converted to the parallel signal by a serial-to-parallel (S/P) converter 23 and supplied to the microprocessor 25. The data transmitted from the vehicle C is referred to as "(reception) data $S_2$ of $f_2$" hereinafter.

The microprocessor 25 comprises: a central processing unit (CPU) 29 to execute the vehicle detecting process, data transmitting and receiving processes, control of the attenuator 13, and the like; a read only memory (ROM) 30 in which the programs which are executed by the CPU 29 are stored; a random access memory (RAM) 31 to store a reference value $V_a$ of the reception data $S_1$ of $f_1$, reception data $S_1$ of $f_1$, reception data $S_2$ of $f_2$, data $S_3$ to be transmitted to the vehicle C, amount of attenuation of the attenuator 13, threshold value $V_{th}$ for the vehicle detection, and the like; a timer 32; an interface 26 to take in the reception data $S_1$ and $S_2$; an interface 28 to send the data $S_3$ to be transmitted to the vehicle C to the P/S converter 27 and to control the attenuator 13; and an interface 33 to connect a modem 35.

The modem 35 performs the communication between the central control unit and the control box 3. The data $S_3$ to be transmitted to the vehicle C and other control data are transmitted from the central control unit to the box 3. The vehicle detection signal and the data $S_2$ sent from the vehicle C, and the like are sent from the box 3 to the central control unit.

The transceiver 6 equipped in the vehicle C includes the transmitting circuit 44, a receiving circuit 39, and a CPU 40. The transmitting circuit 44 is constituted by a oscillating and modulating circuit 41, an amplifier 42, and a band pass filter 43 having the center frequency $f_2$. The data set to the data setting device 9 is used to frequency modulate (MSK) the carrier signal of the frequency $f_2$ in the modulator 41. The modulated signal is sent to the antenna 7 through the amplifier 42 and band pass filter 43 and transmitted from the antenna 7.

The receiving circuit 39 is composed of a band pass filter 36 having the center frequency $f_1$, an amplifier 37, and a demodulator 38. The signal of the frequency $f_1$ transmitted from the transmitting coil 2 is received by the antenna 7 and passes through the filter 36 and is amplified by the amplifier 37. Thereafter, it is demodulated by the demodulator 38. Thus, the data transmitted from the box 3 is taken out and displayed in the display device 8.

The CPU 40 controls the foregoing transmitting and receiving operations, display by the display device 8, readout of the data set to the setting device 9, and the like. Although not shown, the CPU 40 includes a RAM, a ROM, and the like therein.

Figure 3A:
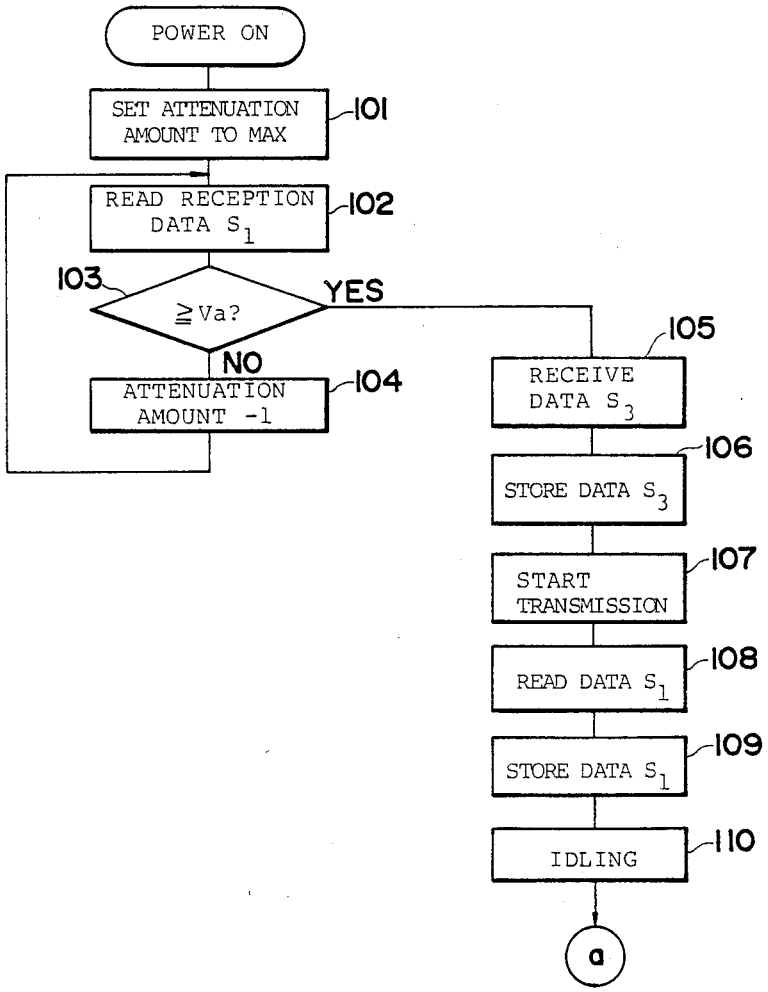
FIGS. 3*a* and 3*b* are flowcharts showing the operation of the system shown in FIG. 2, particularly, the processing procedure by a CPU.
Figure 3B:
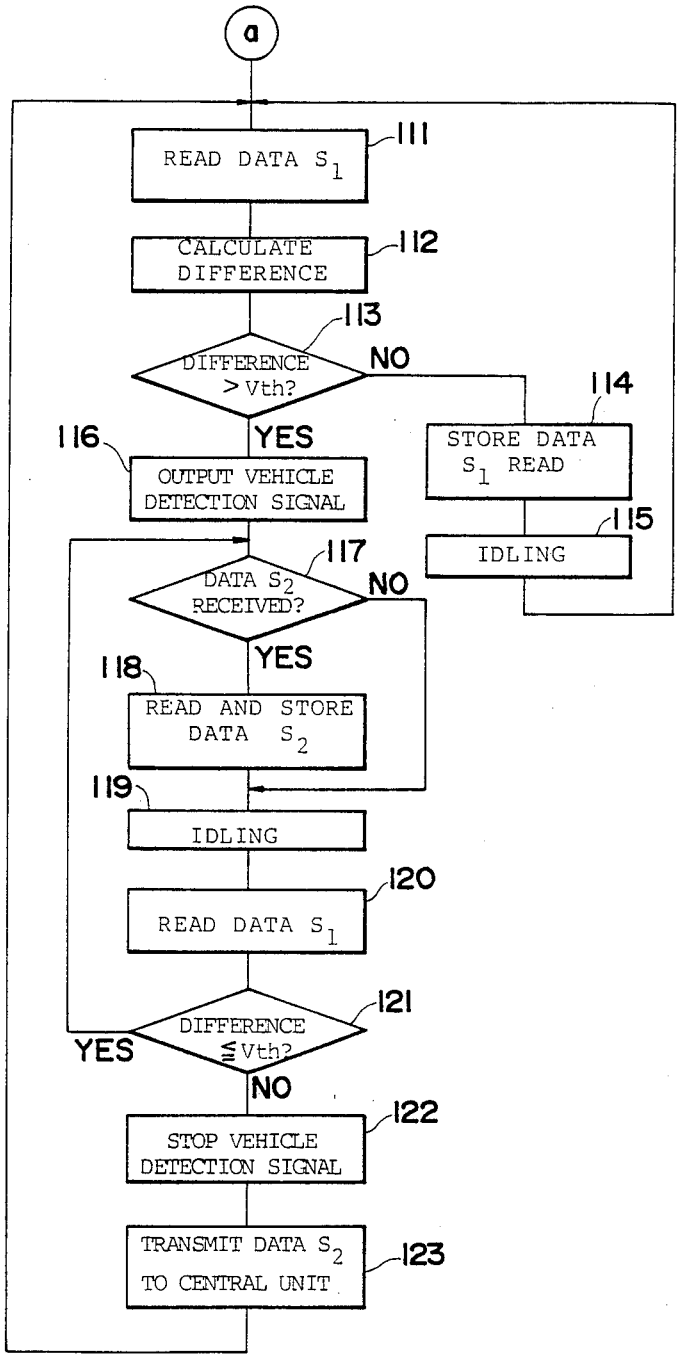
Figure 4:
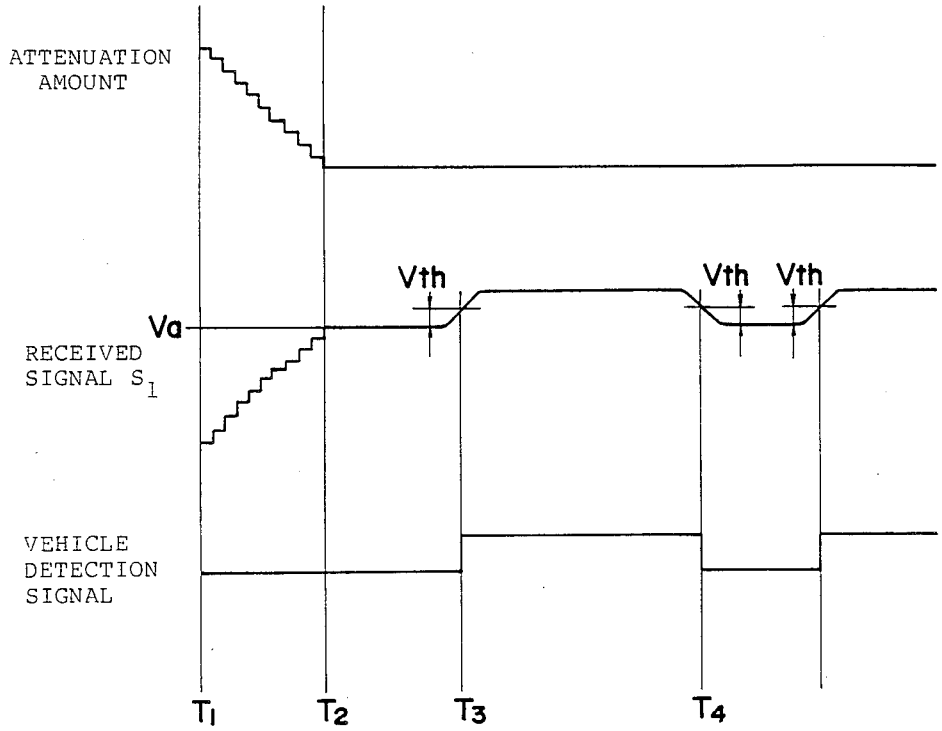
FIGS. 4 and 5 are time charts showing time-dependent changes of signals and values in the system shown in FIG. 2.
Figure 5:
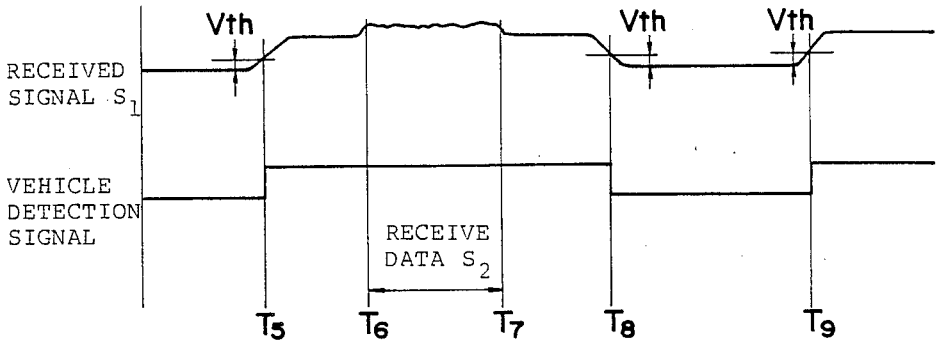

FIGS. 3*a* and 3*b* show the processing procedure of the CPU 29. FIGS. 4 and 5 show the time-dependent changes of various kinds of signals and values, respectively. FIG. 4 shows the case where the data $S_2$ from the vehicle C is not received. FIG. 5 shows the case where the data $S_2$ from the vehicle C is received.

Referring now to FIGS. 3*a*, 3*b*, and 4, when the power supply is turned on at time $T_1$, the amount of attenuation of the attenuator 13 is set to the maximum value. Namely, the transmitting level of the transmitting coil 2 is minimized (step 101). The attenuation amount is stored into the RAM 31. Next, the reception data $S_1$ of $f_1$ as an output value of the A/D converter 19 is read into the microprocessor 25 (step 102). This reception data is checked to see if it has reached the reference value $V_a$ corresponding to a predetermined voltage necessary to detect the vehicle C or not (step 103). If NO, the attenuation amount of the attenuator 13 is reduced by one unit (step 104). Then, the processing routine is returned to step 102. By repeating steps 102 to 104, the attenuation amount of the attenuator 13 is reduced in a stepwise manner and the reception data $S_1$ increases step by step. The attenuation amount stored in the RAM 31 is updated each time the above-mentioned process is repeated.

When the reception data $S_1$ reaches the reference value $V_a$ at time $T_2$ (namely, if YES in step 103), the data $S_3$ to be transmitted to the vehicle C which was sent from the central control unit through the modem 35 is read (step 105) and stored into a predetermined area of the RAM 31 (step 106). The transmitting data $S_3$ is supplied to the modulator 12 through the interface 28 and P/S converter 27 (step 107). Thus, the signal which is outputted from the transmitting coil 2 is the signal modulated by the data $S_3$. Since the transmitting data $S_3$ to the vehicle C is to be received by the vehicle C while it passes in the detection area, its data length is relatively short. Therefore, under control of the CPU 29, or as the function of the modulator 12, the transmitting data $S_3$ is continuously repeated inserted into the transmitting signal at a short period.

Thereafter, the reception data $S_1$ from the A/D converter 19 is again read (step 108) and stored into a predetermined area of the reception data $S_1$ of the RAM 31 (step 109). Next, the idling is carried out for a predetermined period of time in step 110. Namely, the system waits for only a sampling period which is determined by the timer 32.

Thereafter, the reception data $S_1$ is further supplied (step 111) and the difference between this reception data and the precedent reception data which has been obtained one sampling before and which has been stored in the RAM 31 is calculated (step 112). A check is then made to see if the difference exceeds the vehicle detection threshold value $V_{th}$ or not (step 113).

When the difference is less than the value $V_{th}$, the reception data $S_1$ supplied in step 111 is stored into the reception data area of the RAM 31 and the reception data is updated (step 114). This process is executed to cope with the time-dependent change in the level of the received signal. It is desirable to execute this updating process only in the case where the difference between the reception data supplied in step 108 and the present reception data supplied in step 111 is less than a predetermined value. Or, if the process in steps 101 to 104, 108 and 109 is periodically executed when no vehicle exists, it is not always necessary to execute the updating process in step 114. Thereafter, the idling is performed (step 115) and the processing routine is returned to step 111. In this manner, the process in steps 111 to 115 is repeated.

When the vehicle C enters the detection area and the difference between the present reception data and the precedent reception data exceeds the threshold value $V_{th}$ at time $T_3$ (i.e., if YES in step 113), the vehicle detection signal S is outputted through the interface 33 (step 116). The vehicle detection signal S is transmitted to the central control unit through the modem 35.

Thereafter, a check is made to see if the data $S_2$ of $f_2$ has been supplied to the S/P converter 23 or not (step 117). If NO, steps 117 and 118 are skipped. The process in steps 117, 118 and 123 will be explained hereinlater.

After completion of the idling (step 119), the reception data $S_1$ is taken in (step 120). The difference between this reception data and the reception data stored in the RAM 31 in step 109 or 114 is calculated and this difference is checked to see if it is below the threshold value $V_{th}$ or not (step 121). If the difference still exceeds $V_{th}$, the process in steps 119 to 121 is repeated.

When the vehicle C has passed the detection area where the magnetic field H exists and the difference becomes smaller than the value $V_{th}$ at time $T_4$, the generation of the vehicle detection signal S is stopped (step 122). Thereafter, step 11 follows again.

The communication between the vehicle C and the control box 3 will then be described with reference to FIG. 5.

When the signal of the frequency $f_1$ transmitted from the transmitting coil 2 is received by the receiving circuit 39 in the vehicle C, the CPU 40 adds the data set to the setting device 9, if it exists, to the signal of the frequency $f_2$ and transmits this signal from the transmitting circuit 44.

Only when the data $S_3$ is included in the signal transmitted from the transmitting coil 2, in the receiving circuit 39 shown in FIG. 2, the signal indicative of the data $S_3$ is supplied from the demodulator 38 to the CPU 40. However, the CPU 40 may start the transmission of the transmitting data to the box 3 irrespective of the presence or absence of the data $S_3$ when the vehicle C enters the detection area and receives the signal of the frequency $f_1$.

When the signal of the frequency $f_2$ modulated by the data is sent from the antenna 7, it is received by the receiving circuit 20 and the reception data $S_2$ of $f_2$ is stored into the RAM 31 through the interface 26 (steps 117 and 118). In the time chart shown in FIG. 5, the vehicle is detected for the interval of $T_5$ to $T_8$ and the reception data $S_2$ is received for the interval of $T_6$ to $T_7$ within that interval. After stop of the generation of the vehicle detection signal (step 122), the reception data $S_2$ stored in the RAM 31 is transmitted to the central control unit by the modem 35 (step 123).

In FIG. 5, the reception data $S_2$ is shown in the received signal $S_1$ for convenience of explanation. Such a phenomenon could also occur in the case where the pass band of the band pass filter 17 is wide.

Figure 6:
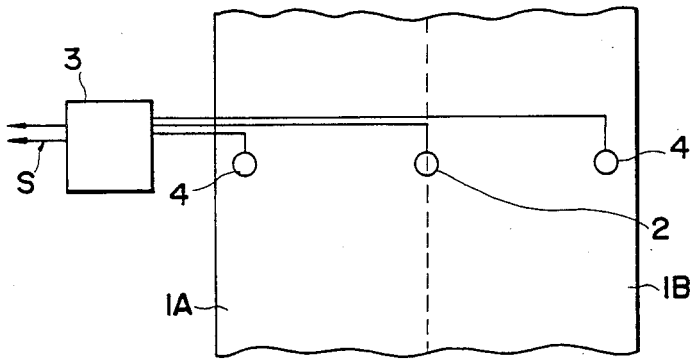
FIG. 6 shows an example of another arrangement of transmitting and receiving coils.

As shown in FIG. 6, in the case where two adjacent roadways are formed, the transmitting coil 2 is installed at the boundary portion of both roadways 1A and 1B and two receiving coils 4 are arranged on the outsides of the roadways 1A and 1B. In this way, the vehicle detecting system can be also constituted such that one transmitting coil 2 is commonly used to detect vehicles which pass two roadways 1A and 1B.

What is claimed is:

1. A vehicle detecting method which can communicate with vehicles, comprising the steps of:

arranging a transmitting coil on one side of a predetermined detection area set over a roadway of vehicles and a receiving coil on the other side of said detection area, the transmitting coil emitting a first high frequency signal having a first frequency and the receiving coil receiving the first high frequency signal of the first frequency and a second high frequency signal having a second frequency different from said first frequency;

applying said first high frequency signal of said first frequency to said transmitting coil to form a high frequency magnetic field between the transmitting coil and the receiving coil, and detecting the existence of a vehicle by detecting a change in a signal characteristic of a signal induced in said receiving coil when the vehicle enters said magnetic field;

modulating said first high frequency signal which is applied to the transmitting coil by data to be transmitted to the vehicle; and receiving by the receiving coil said second high frequency signal which is transmitted from the vehicle and also demodulating the received second high frequency signal, thereby executing at least a unidirectional communication with the vehicle.

2. A method according to claim 1, wherein said modulation and said demodulation are modulation and demodulation of frequency or phase.

3. A method according to claim 1, wherein the vehicle includes a transmitter unit and a receiver unit and when said first high frequency signal of the first frequency from said transmitting coil is received by said receiver unit of said vehicle, if data to be transmitted from the vehicle to the receiving coil exists, this data is added to said second high frequency signal of the second frequency and transmitted from said transmitter unit to said receiving coil.

4. A vehicle detecting system which can communicate with vehicles, comprising:

a transmitting coil arranged on one side of a predetermined detection area set over a roadway of vehicles and a receiving coil arranged on the other side of said detection area;

a transmitting circuit for applying a first high frequency signal having a first frequency to said transmitting coil;

means for modulating said first high frequency signal which is applied to the transmitting coil by data to be transmitted to the vehicle;

said transmitting coil for emitting said first high frequency signal having said first frequency;

said receiving coil receiving the first high frequency signal of the first frequency and a second high frequency signal which is emitted from a vehicle and which has a second frequency different from said first frequency;

vehicle detecting means which outputs a vehicle detection signal in response to a level change over a predetermined level of said first high frequency signal of the first frequency which is induced in said receiving coil;

a receiving circuit for demodulating said second high frequency signal which has said second frequency different from said first frequency of the first high frequency signal and is induced in the receiving coil; and means for controlling the level of the first high frequency signal which is supplied from said transmitting circuit to the transmitting coil so as to keep constant the level of the first high frequency signal of the first frequency which is induced in the receiving coil when no vehicle exists in the detection area, thereby executing at least a unidirectional communication with the vehicle.

5. A vehicle detecting system according to claim 4, wherein said transmitting coil and said receiving coil are buried under the roadway surface.

6. A vehicle detecting system according to claim 4, wherein said transmitting coil and said receiving coil are disposed on the roadway.

7. A vehicle detecting system according to claim 4, wherein said transmitting coil and said receiving coil are arranged above the roadway.

8. A vehicle detecting system according to claim 4, wherein said vehicle detecting means includes comparing means for comparing a level of the electrical signal, which is induced in said receiving coil and has said first frequency, with a predetermined reference level.

9. A vehicle detecting system according to claim 4, wherein said vehicle detecting means samples the level of the first high frequency signal of the first frequency which is induced in the receiving coil at periodic time intervals and obtains a change amount in said signal level, then compares this change amount with a predetermined reference value.

10. A vehicle detecting system which can communicate with vehicles, comprising:

a transmitting coil arranged on one side of a predetermined detection area set over a roadway of vehicles and a receiving coil arranged on the other side of said detection area;

a transmitting circuit for applying a first high frequency signal having a first frequency to said transmitting coil;

vehicle detecting means which outputs a vehicle detection signal in response to a level change over a predetermined level of said first high frequency signal of the first frequency which is induced in said receiving coil;

a receiving circuit for demodulating a second high frequency signal which has a second frequency different from said first frequency of the first high frequency signal and is induced in the receiving coil; and means for controlling the level of the first high frequency signal which is supplied from said transmitting circuit to the transmitting coil so as to keep constant the level of the first high frequency signal of the first frequency which is induced in the receiving coil when no vehicle exists in the detection area, wherein said transmitting circuit has a circuit to generate said first high frequency signal of the first frequency and a modulator to modulate the first high frequency signal of the first frequency generated by the data to be transmitted to the vehicle.

11. A vehicle detecting system which can communicate with vehicles, comprising:

a transmitting coil, arranged on one side of a predetermined detection area set over a roadway of vehicles, for emitting a first high frequency signal having a first frequency, and a receiving coil, arranged on the other side of said detection area, for receiving said first high frequency signal of the first frequency and a second high frequency signal adapted to be transmitted from one of said vehicles and having a second frequency different from said first frequency;

a transmitting circuit for applying the first high frequency signal having the first frequency to said transmitting coil, said transmitting circuit having a circuit to generate the first high frequency signal of the first frequency and a modulator to modulate the first high frequency signal of the first frequency generated in accordance with data to be transmitted to the vehicle;

vehicle detecting means which outputs a vehicle detection signal in response to a change over a predetermined amount of the characteristic in said first high frequency signal of the first frequency which is induced in said receiving coil; and a receiving circuit for demodulating said second high frequency signal of said second frequency which is induced in said receiving coil.

12. A vehicle detecting system according to claim 11, wherein said transmitting coil and said receiving coil are buried under the roadway surface.

13. A vehicle detecting system according to claim 11, wherein said transmitting coil and said receiving coil are disposed on the roadway.

14. A vehicle detecting system according to claim 1, wherein said transmitting coil and said receiving coil are arranged above the roadway.

15. A vehicle detecting system according to claim 11, wherein said vehicle detecting means includes comparing means for comparing a level of the electrical signal, which is induced in said receiving coil and has said first frequency, with a predetermined reference level.

16. A vehicle detecting system according to claim 11, further comprising means for controlling the level of the first high frequency signal which is supplied from said transmitting circuit to the transmitting coil so as to keep constant the level of the first high frequency signal of the first frequency which is induced in to receiving coil when no vehicle exists in the detection area.

17. A vehicle detecting system according to claim 11, wherein said vehicle detecting means samples the level of the first high frequency signal of the first frequency which is induced in the receiving coil at periodic time intervals and obtains a change amount in said signal level, then compares this change amount with a predetermined reference value.

18. A vehicle detecting system according to claim 11 wherein the vehicle is equipped with a transceiver apparatus which comprises:

an antenna for emitting said second high frequency signal of said second frequency and for receiving said first high frequency signal of said first frequency signal;

a transmitting circuit for applying to said antenna said second high frequency signal of said second frequency which is modulated by data contained in said first high frequency signal received by said antenna; and a receiving circuit for demodulating said first frequency signal of said first frequency which is induced in said antenna.

19. The vehicle detecting system according to claim 4, further comprising:

an antenna for emitting said second high frequency signal of said second frequency and for receiving said first high frequency signal of said first frequency signal;

a transmitting circuit for applying to said antenna said second high frequency signal of said second frequency which is modulated by data contained in said first high frequency signal received by said antenna; and a receiving circuit for demodulating said first frequency of said first frequency which is induced in said antenna.

20. A vehicle detecting system according to claim 11, further comprising:

an antenna for emitting said second high frequency signal of said second frequency and for receiving said first high frequency signal of first frequency signal;

a transmitting circuit for applying to said antenna said second high frequency signal of said second frequency which is modulated by data contained in said first high frequency signal received by said antenna; and a receiving circuit for demodulating said first high frequency signal of said first high frequency signal which is induced in said antenna.

* * * * *